US011243012B2

(12) United States Patent
Grove

(10) Patent No.: US 11,243,012 B2
(45) Date of Patent: Feb. 8, 2022

(54) PORTABLE HEAT SHIELD ASSEMBLY

(71) Applicant: Clifford Grove, Waxahachie, TX (US)

(72) Inventor: Clifford Grove, Waxahachie, TX (US)

( * ) Notice: Subject to any disclaimer, the term of this patent is extended or adjusted under 35 U.S.C. 154(b) by 204 days.

(21) Appl. No.: 16/680,181

(22) Filed: Nov. 11, 2019

(65) Prior Publication Data

US 2021/0140679 A1 May 13, 2021

(51) Int. Cl.

| | |
|---|---|
| ***F24H 9/02*** | (2006.01) |
| ***F24B 1/181*** | (2006.01) |
| ***F24H 9/18*** | (2006.01) |
| ***F24C 1/16*** | (2006.01) |

(52) U.S. Cl.

CPC ..... *F24H 9/02* (2013.01); *F24B 1/181* (2013.01); *F24C 1/16* (2013.01); *F24H 9/1854* (2013.01)

(58) Field of Classification Search

CPC ..... F24H 9/02; F24C 1/10; F24C 1/12; F24C 1/16

See application file for complete search history.

(56) References Cited

U.S. PATENT DOCUMENTS

| | | | | |
|---|---|---|---|---|
| 5,682,872 | A | 11/1997 | Whitted | |
| 5,785,046 | A | 7/1998 | Colla | |
| 7,383,836 | B2 | 6/2008 | Klemming | |
| 8,991,382 | B1 | 3/2015 | Mau | |
| D792,567 | S | 7/2017 | Zemel | |
| 10,036,553 | B2 | 7/2018 | Kramer | |
| 2003/0056782 | A1 * | 3/2003 | Liang | F24C 1/12 126/92 B |

FOREIGN PATENT DOCUMENTS

| | | | | |
|---|---|---|---|---|
| EP | 0315548 | A1 * | 5/1989 | E02D 5/08 |
| WO | WO2018160767 | | 9/2018 | |

* cited by examiner

*Primary Examiner* — Jason Lau

(57) ABSTRACT

A portable heater shield assembly for directing heat laterally away from a heat source includes a plurality of panels that removably engaging each other to form a disk. Each of the panels is comprised of a heat resistant material. A plurality of brackets is each removably coupled to a heat source having the brackets being vertically oriented. The disk is positionable on top of the brackets when the brackets are removably coupled to the heat source having the disk spaced upwardly from the heat source. In this way the disk directs heat laterally away from the heat source for warming users sitting around the heat source.

6 Claims, 4 Drawing Sheets

PORTABLE HEAT SHIELD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to shield devices and more particularly pertains to a new shield device for directing heat laterally away from a heat source.

(2) Description of Related Art Including Information Disclosed Under 37 CFR 1.97 and 1.98

The prior art relates to shield devices. The prior art generally describes heat shields that direct heat from a heat source in a vertical direction. The heat shields described in the prior art are movably coupled together in a variety of methods, including being hingedly coupled together and being removably coupled together. The prior art additionally includes heat shields that are constructed with mesh to pass air therethrough.

BRIEF SUMMARY OF THE INVENTION

An embodiment of the disclosure meets the needs presented above by generally comprising a plurality of panels that removably engaging each other to form a disk. Each of the panels is comprised of a heat resistant material. A plurality of brackets is each removably coupled to a heat source having the brackets being vertically oriented. The disk is positionable on top of the brackets when the brackets are removably coupled to the heat source having the disk spaced upwardly from the heat source. In this way the disk directs heat laterally away from the heat source for warming users sitting around the heat source.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
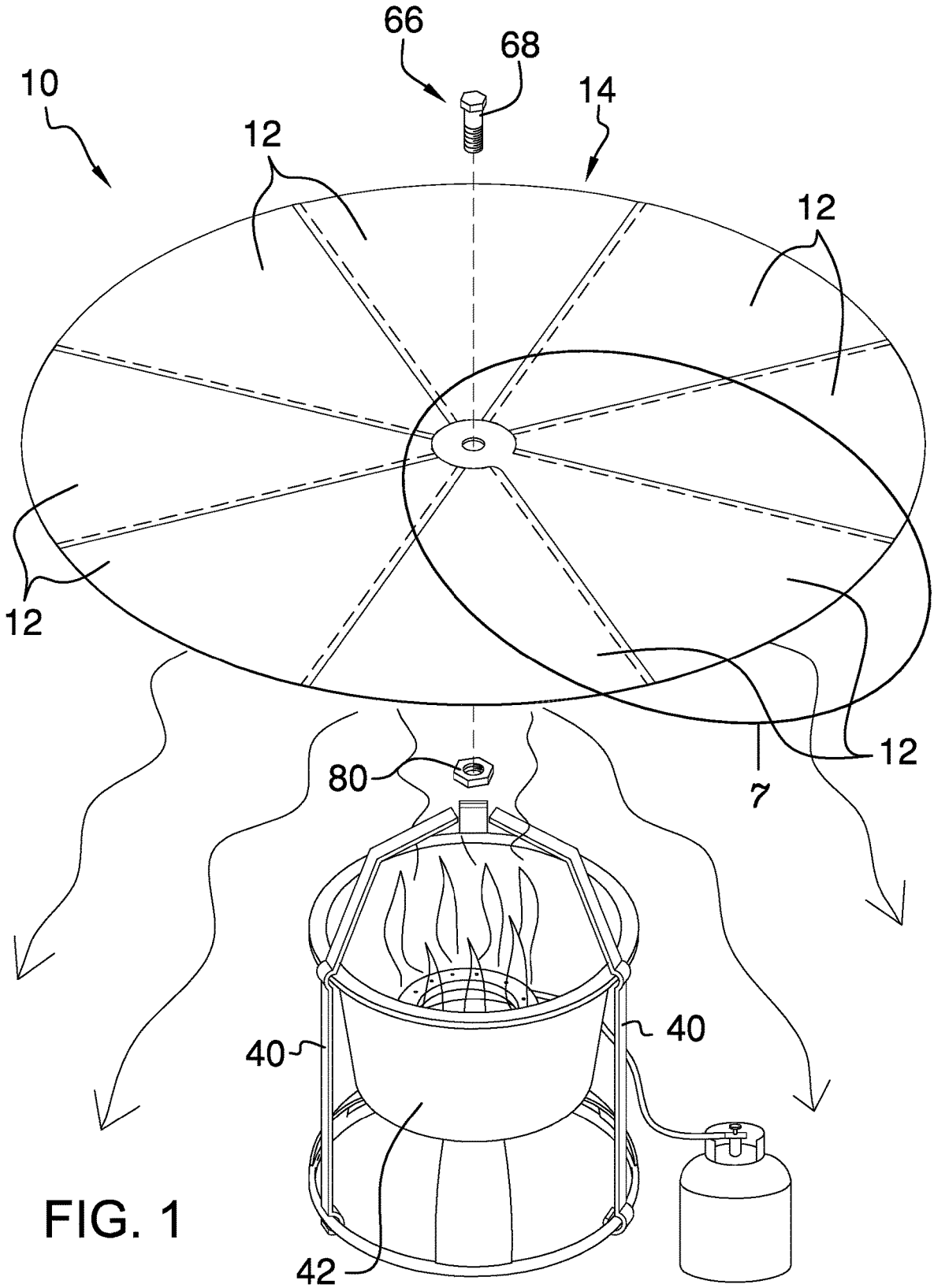
FIG. 1 is an exploded perspective view of a portable heater shield assembly according to an embodiment of the disclosure.
Figure 2:
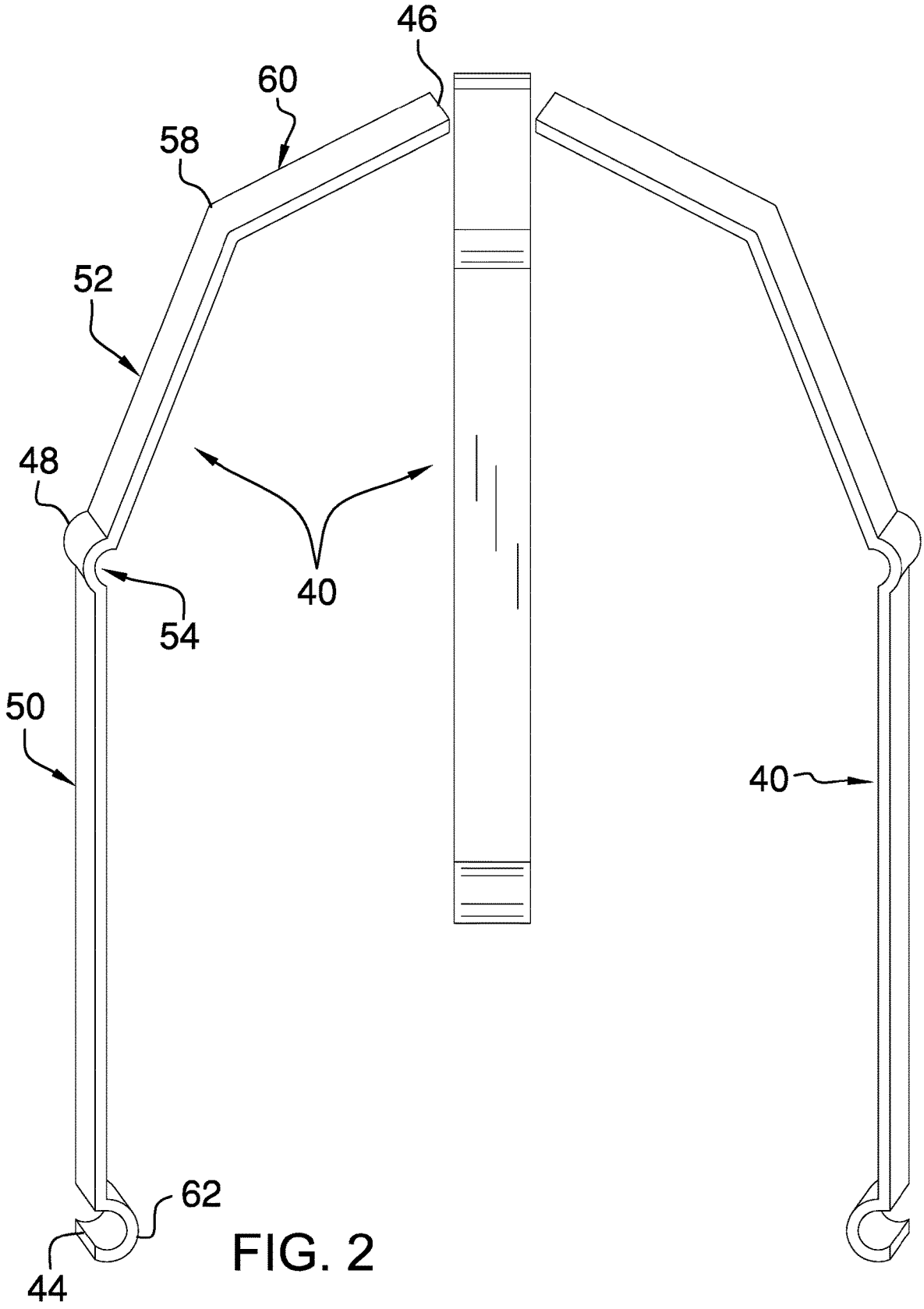
FIG. 2 is a perspective view of a plurality of brackets of an embodiment of the disclosure.
Figure 6:
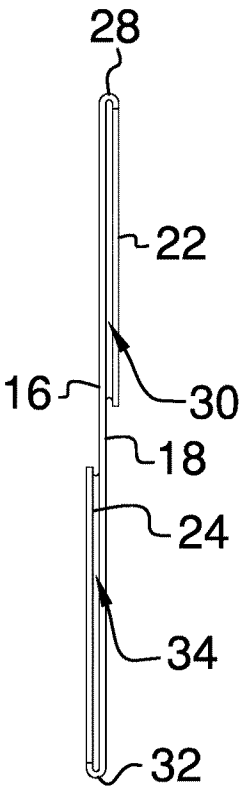
FIG. 6 is a front view of an embodiment of the disclosure.
Figure 5:
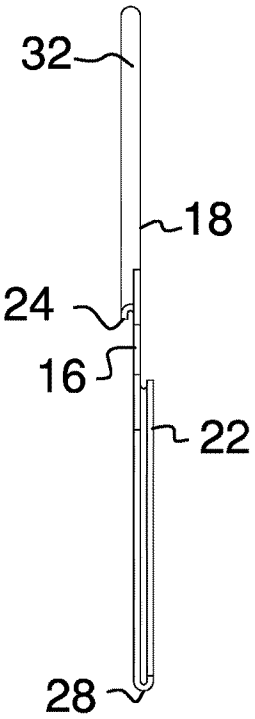
FIG. 5 is a back view of an embodiment of the disclosure.
Figure 3:
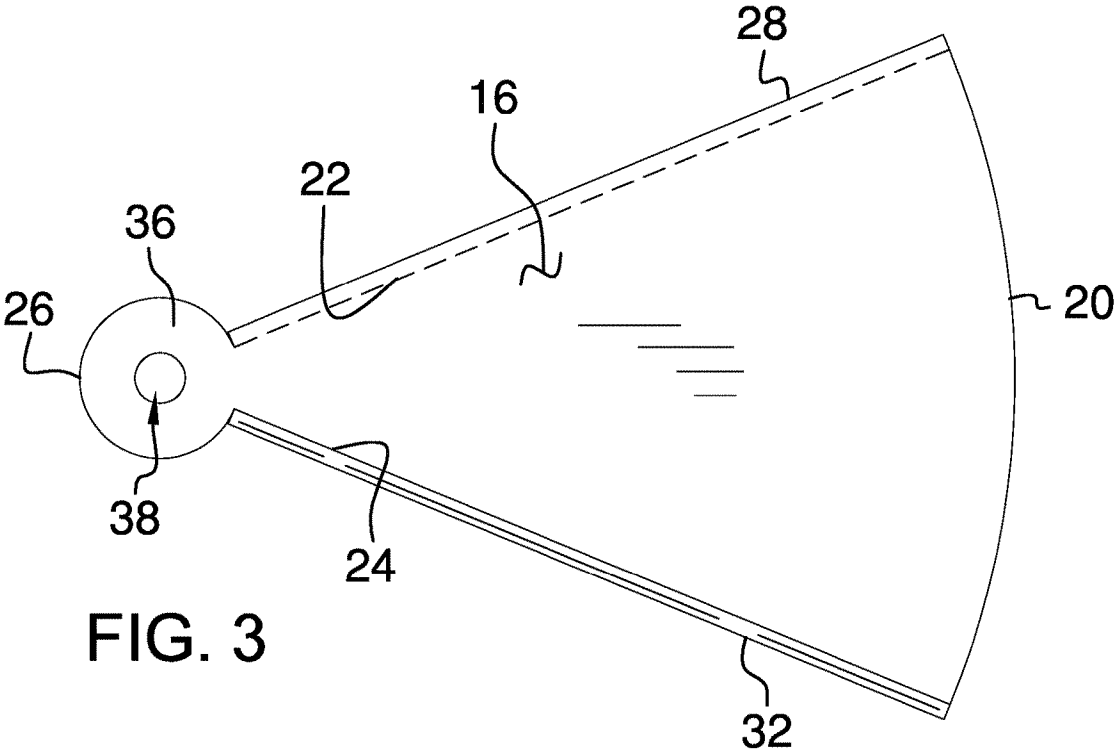
FIG. 3 is a top phantom view of an embodiment of the disclosure.
Figure 4:
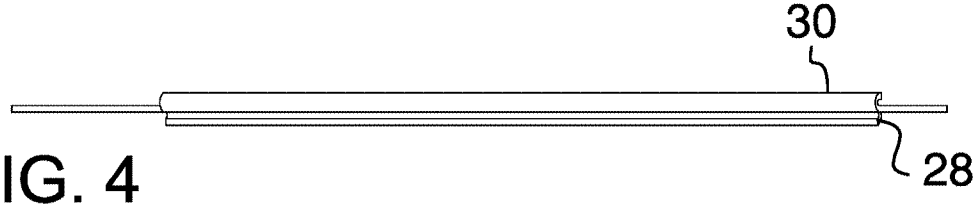
FIG. 4 is a right side view of an embodiment of the disclosure.
Figure 7:
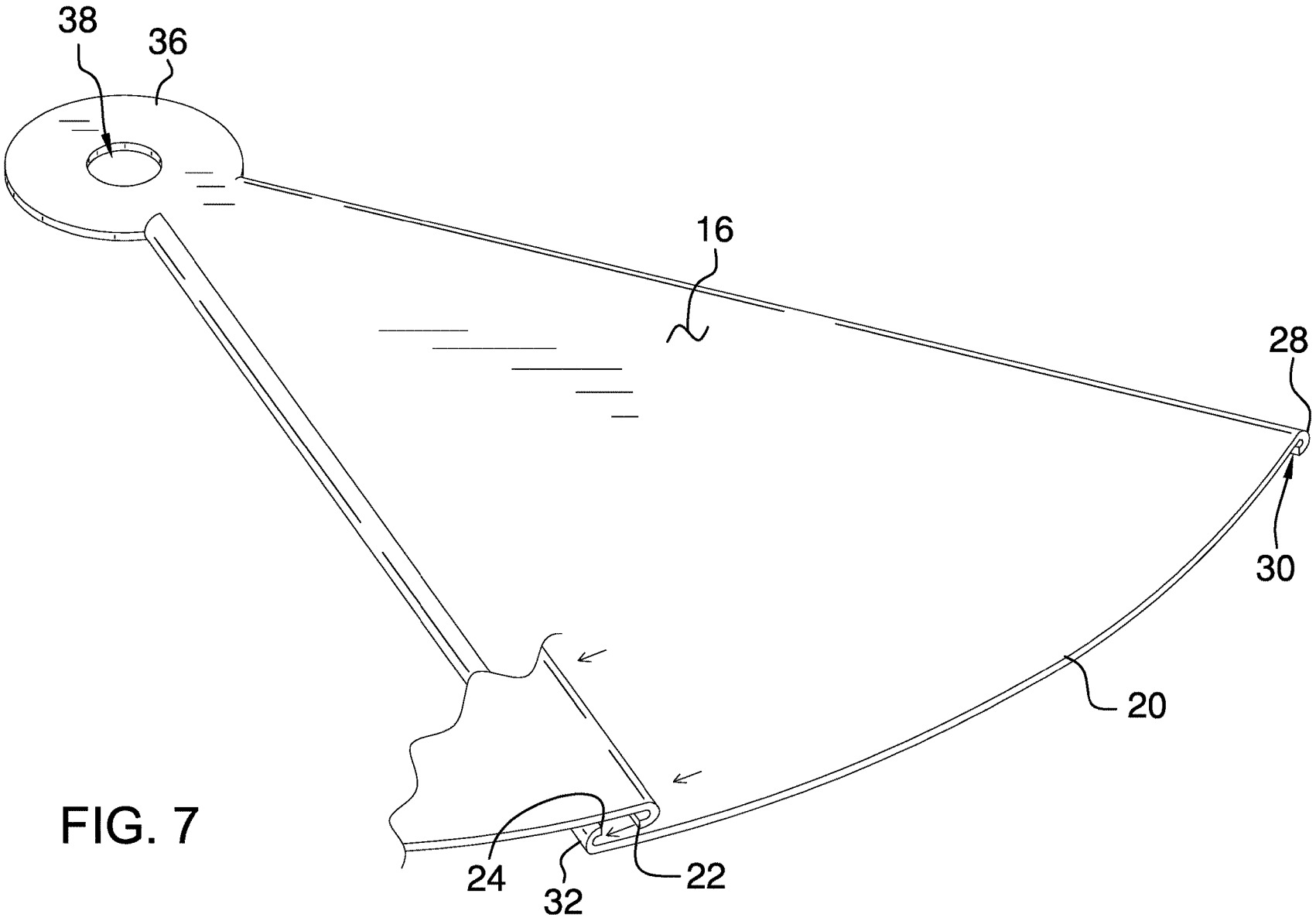
FIG. 7 is a detail view taken from circle 7 of FIG. 1 of an embodiment of the disclosure.

With reference now to the drawings, and in particular to FIGS. 1 through 7 thereof, a new shield device embodying the principles and concepts of an embodiment of the disclosure and generally designated by the reference numeral 10 will be described.

As best illustrated in FIGS. 1 through 7, the portable heater shield assembly 10 generally comprises a plurality of panels 12 that each widens along a longitudinal axis such that each of the panels 12 has a trapezoidal shape. The plurality of panels 12 removably engages each other such that the plurality of panels 12 forms a disk 14 having each of the panels 12 defining a respective sector of the disk 14. Additionally, each of the panels 12 is comprised of a heat resistant material such as steel or other similar, rigid material.

Each of the panels 12 has a top surface 16, a bottom surface 18, a front edge 20, a first lateral edge 22, a second lateral edge 24 and a back edge 26. Each of the first lateral edge 22 and the second lateral edge 24 angles outwardly between the back edge 26 and the front edge 20 such that the front edge 20 has a length that is greater than the length of the back edge 26. The front edge 20 is rounded between the first lateral edge 22 and the second lateral edge 24.

Each of the panels 12 has a first roll 28 extending along an entire length of the first lateral edge 22 such that the first lateral edge 22 is spaced upwardly from the top surface 16. Thus, a first space 30 is defined between the first lateral edge 22 and the top surface 16. Each of the panels 12 has a second roll 32 extending along an entire length of the second lateral edge 24 such that the second lateral edge 24 is spaced downwardly from the bottom surface 18. Thus, a second space 34 is defined between the second lateral edge 24 and the bottom surface 18.

The first space 30 on each of the panels 12 insertably receives the second lateral edge 24 of an adjacent one of the panels 12 when the panels 12 are assembled to define the disk 14. Additionally, the second space 34 in each of the panels 12 insertably receives the first lateral edge 22 of an adjacent one of the panels 12 when the panels 12 are assembled to define the disk 14. The plurality of panels 12 includes a master panel 35 and the back edge 26 of the master panel 35 curves outwardly to define a lobe 36 on the master panel 35. The lobe 36 has a fastener aperture 38 extending through the top surface 16 and the bottom surface 18 of the master panel 35. The lobe 36 is centrally positioned on the disk 14 when the panels 12 are assembled.

A plurality of brackets 40 is provided and each of the brackets 40 is removably coupled to a heat source 42 having the brackets 40 being vertically oriented. The heat source 42 may be a propane burner, a wood burning fire pit or any other type of heat source that would commonly be used outdoors. The disk 14 defined by the plurality of panels 12 is positionable on top of the brackets 40 when the brackets 40 are removably coupled to the heat source 42. In this way the disk 14 is spaced upwardly from the heat source 42 having the disk 14 lying on a horizontal plane. Thus, the disk 14 directs heat laterally away from the heat source 42 for warming users that are sitting around the heat source 42.

Each of the brackets 40 has a first end 44 and a second end 46, and each of the brackets 40 is elongated between the first end 44 and the second end 46. Each of the brackets 40 has a first bend 48 thereon to define a first portion 50 forming an angle with a second portion 52. The first bend 48 bulges outwardly to define a recess 54 in each of the brackets 40 and the recess 54 in each of brackets 40 engages a upper lip 56 of the heat source 42 for retaining the brackets 40 on the heat source 42.

Each of the brackets 40 has a second bend 58 positioned between the first bend 48 and the second end 46 to define a third portion 60 forming an angle with the second portion 52. The brackets 40 are distributed around the heat source 42 having the third portion 60 of the brackets 40 being directed toward each other such that the second end 46 of each of the brackets 40 is spaced above the heat source 42. Each of the brackets 40 has a rolled portion 62 that is positioned adjacent to the first end 44 for releasably engaging a bottom 64 of the heat source 42.

A fastener 66 is included and the fastener 66 is extendable through the disk 14 defined by the panels 12 and engages the brackets 40. In this way the disk 14 is retained on the brackets 40. The fastener 66 comprises a bolt 68 that is extendable through the fastener aperture 38 in the lobe 36 of the master panel 35 when the panels 12 are assembled to form the disk 14. The fastener 66 includes a nut 70 that threadably engages the bolt 70. The nut 70 engages the second end 46 of each of the brackets 40 for retaining the disk 14 on top of the brackets 40.

In use, the plurality of panels 12 is assembled to form the disk 14 and each of the brackets 40 is coupled to the heat source 42. The disk 14 is laid on top of the brackets 40 such that the disk 14 is spaced upwardly from the heat source 42. In this way the disk 14 directs heat produced by the heat source 42 laterally away from the heat source 42 and inhibits the heat from travelling vertically from the heat source 42. Thus, the majority of the heat is directed toward the users who are sitting around the heat source 42 for warmth. In this way the brackets 40 and the disk 14 enhance the user's comfort with respect to being warmed by the heat source 42.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable heater shield assembly being configured to be mounted over a portable heater to direct heat laterally from the portable heater toward a user, said assembly comprising:

a plurality of panels, each of said panels widening along a longitudinal axis such that each of said panels has a trapezoidal shape, said plurality of panels removably engaging each other such that said plurality of panels forms a disk having each of said panels defining a respective sector of the disk, each of said panels being comprised of a heat resistant material;

a plurality of brackets, each of said brackets being removably coupled to a heat source having said brackets being vertically oriented, said disk defined by said plurality of panels being positionable on top of said brackets when said brackets are removably coupled to the heat source having said disk being spaced upwardly from the heat source wherein said disk is configured to direct heat laterally away from the heat source for warming users sitting around the heat source;

a fastener being extendable through said disk defined by said panels and engaging said brackets for retaining said disk on said brackets;

wherein each of said panels has a top surface, a bottom surface, a front edge, a first lateral edge, a second lateral edge and a back edge, each of said first lateral edge and said second lateral edge angling outwardly between said back edge and said front edge such that said front edge has a length being greater than the length of said back edge, said front edge being rounded between said first lateral edge and said second lateral edge;

wherein each of said panels has a first roll extending along an entire length of said first lateral edge such that said first lateral edge is spaced upwardly from said top surface to define a first space between said first lateral edge and said top surface;

wherein each of said panels has a second roll extending along an entire length of said second lateral edge such that said second lateral edge is spaced downwardly from said bottom surface to define a second space between said second lateral edge and said bottom surface;

wherein said first space on each of said panels insertably receiving said second lateral edge of an adjacent one of said panels when said panels are assembled to define said disk, said second space in each of said panels insertably receiving said first lateral edge of an adjacent one of said panels when said panels are assembled to define said disk; and wherein said plurality of panels includes a master panel, said back edge of said master panel curving outwardly to define a lobe on said master panel, said lobe having a fastener aperture extending through said top surface and said bottom surface of said master panel, said lobe being centrally positioned on said disk when said panels are assembled.

2. The assembly according to claim 1, wherein each of said brackets has a first end and a second end, each of said brackets being elongated between said first end and said second end, each of said brackets having a first bend thereon to define a first portion forming an angle with a second portion, said first bend bulging outwardly to define a recess in each of said brackets wherein said recess in each of brackets is configured to engage a lip of the heat source for retaining said brackets on the heat source.

3. The assembly according to claim 2, wherein each of said brackets has a second bend being positioned between said first bend and said second end to define a third portion forming an angle with said second portion, said brackets being distributed around the heat source having said third portion of said brackets being directed toward each other such that said second end of each of said brackets is spaced above the heat source.

4. The assembly according to claim 3, wherein each of said brackets has a rolled portion being positioned adjacent to said first end for releasably engaging a bottom of the heat source.

5. The assembly according to claim 3, wherein said fastener comprises:

a bolt being extendable through said fastener aperture in said lobe of said master panel when said panels are assembled to form said disk; and a nut threadably engaging said bolt, said nut engaging said second end of each of said brackets for retaining said disk on top of said brackets.

6. A portable heater shield assembly being configured to be mounted over a portable heater to direct heat laterally from the portable heater toward a user, said assembly comprising:

a plurality of panels, each of said panels widening along a longitudinal axis such that each of said panels has a trapezoidal shape, said plurality of panels removably engaging each other such that said plurality of panels forms a disk having each of said panels defining a respective sector of the disk, each of said panels being comprised of a heat resistant material, each of said panels having a top surface, a bottom surface, a front edge, a first lateral edge, a second lateral edge and a back edge, each of said first lateral edge and said second lateral edge angling outwardly between said back edge and said front edge such that said front edge has a length being greater than the length of said back edge, said front edge being rounded between said first lateral edge and said second lateral edge, each of said panels having a first roll extending along an entire length of said first lateral edge such that said first lateral edge is spaced upwardly from said top surface to define a first space between said first lateral edge and said top surface, each of said panels having a second roll extending along an entire length of said second lateral edge such that said second lateral edge is spaced downwardly from said bottom surface to define a second space between said second lateral edge and said bottom surface, said first space on each of said panels insertably receiving said second lateral edge of an adjacent one of said panels when said panels are assembled to define said disk, said second space in each of said panels insertably receiving said first lateral edge of an adjacent one of said panels when said panels are assembled to define said disk, said plurality of panels including a master panel, said back edge of said master panel curving outwardly to define a lobe on said master panel, said lobe having a fastener aperture extending through said top surface and said bottom surface of said master panel, said lobe being centrally positioned on said disk when said panels are assembled;

a plurality of brackets, each of said brackets being removably coupled to a heat source having said brackets being vertically oriented, said disk defined by said plurality of panels being positionable on top of said brackets when said brackets are removably coupled to the heat source having said disk being spaced upwardly from the heat source wherein said disk is configured to direct heat laterally away from the heat source for warming users sitting around the heat source, each of said brackets having a first end and a second end, each of said brackets being elongated between said first end and said second end, each of said brackets having a first bend thereon to define a first portion forming an angle with a second portion, said first bend bulging outwardly to define a recess in each of said brackets wherein said recess in each of brackets is configured to engage a lip of the heat source for retaining said brackets on the heat source, each of said brackets having a second bend being positioned between said first bend and said second end to define a third portion forming an angle with said second portion, said brackets being distributed around the heat source having said third portion of said brackets being directed toward each other such that said second end of each of said brackets is spaced above the heat source, each of said brackets having a rolled portion being positioned adjacent to said first end for releasably engaging a bottom of the heat source; and a fastener being extendable through said disk defined by said panels and engaging said brackets for retaining said disk on said brackets, said fastener comprising:

a bolt being extendable through said fastener aperture in said lobe of said master panel when said panels are assembled to form said disk; and a nut threadably engaging said bolt, said nut engaging said second end of each of said brackets for retaining said disk on top of said brackets.

* * * * *